US006941765B2

(12) United States Patent
Sung

(10) Patent No.: US 6,941,765 B2
(45) Date of Patent: Sep. 13, 2005

(54) FOOD PREPARATION TABLE

(75) Inventor: Ki Rin Sung, Seoul (KR)

(73) Assignee: Daewoo Electronics Corporation (KR)

( * ) Notice: Subject to any disclaimer, the term of this patent is extended or adjusted under 35 U.S.C. 154(b) by 0 days.

(21) Appl. No.: 10/612,794

(22) Filed: Jul. 1, 2003

(65) Prior Publication Data

US 2004/0168458 A1 Sep. 2, 2004

(30) Foreign Application Priority Data

Feb. 28, 2003 (KR) ..... 10-2003-0012831
Feb. 28, 2003 (KR) ..... 10-2003-0012830

(51) Int. Cl.[7] ..... F25D 23/12
(52) U.S. Cl. ..... 62/258; 62/298
(58) Field of Search ..... 62/258, 298

(56) References Cited

U.S. PATENT DOCUMENTS 3,712,078 A * 1/1973 Maynard et al. ..... 62/448
4,802,340 A * 2/1989 Johnson ..... 62/229
5,168,719 A * 12/1992 Branz et al. ..... 62/258
5,182,924 A * 2/1993 Trulaske, Sr. ..... 62/255
5,191,769 A * 3/1993 Mangini et al. ..... 62/258
6,082,131 A * 7/2000 Hirosawa et al. ..... 62/448
6,089,036 A * 7/2000 Carlson et al. ..... 62/256
6,385,990 B1 * 5/2002 Lee ..... 62/407
6,519,970 B1 * 2/2003 Rafalovich et al. ..... 62/448
6,564,569 B1 * 5/2003 Havens ..... 62/258

* cited by examiner

*Primary Examiner*—William E. Tapolcai
(74) *Attorney, Agent, or Firm*—Anderson Kill & Olick, PC

(57) ABSTRACT

A food preparation table includes a food storage compartment which preserves foodstuff items; and a cooled air shower device which is disposed above the food storage compartment and supplies cooled air thereinto. The cooled air shower device distributes the cooled air evenly along a substantially entire length of the storage compartment. Further, the refrigerating system is installed in a chamber disposed inside the food preparation table and is extractable therefrom.

7 Claims, 5 Drawing Sheets

FOOD PREPARATION TABLE

FIELD OF THE INVENTION

The present invention relates to a food preparation table; and more particularly, to a food preparation table which is capable of increasing uniformity of temperature distribution inside a storage compartment by distributing cooled air evenly thereinto, and is capable of providing sufficient workspace for maintenance of a refrigerating system by rendering the refrigerating system extractable from a chamber in which the refrigerating system is installed.

BACKGROUND OF THE INVENTION

As well known, widely used for preparing pizza, sandwich, salad and the like, a food preparation table includes a counter top for providing a place on which foodstuff is prepared; a pan area disposed adjacent to the counter top, which accommodates a plural number of pans containing ingredient foodstuff items, e.g., sliced tomatoes and lettuces; a food storage compartment disposed below the counter top, which preserves other items therein; and a refrigerating system for supplying cooled air to the pan area and the storage compartment.

Further, as disclosed in U.S. Pat. Nos. 5,168,719, 5,182,923, 5,182,924 and 6,385,990, the food preparation table further includes an arrangement for guiding air cooled in the refrigerating system into the pan area to cool effectively the ingredient foodstuff items in the pans deposited thereon; and an arrangement for guiding the cooled air into the food storage compartment. However, since such a food preparation table cannot distribute cooled air evenly into the food storage compartment, an inner space of the storage compartment is not effectively cooled so that uniformity of a temperature distribution therein is seriously deteriorated.

The refrigerating system of the food preparation table is provided with an intake device for drawing air from the storage compartment, an evaporator for cooling the air drawn from the storage compartment, a condenser for supplying a liquefied refrigerant to the evaporator and a compressor for supplying a compressed refrigerant to the condenser. And in general, the refrigerating system is disposed in a compact space defined by an outer and/or inner walls of the food preparation table. Therefore, when repair or replacement of any components in such a refrigerating system is carried out, it is difficult to obtain a sufficient workspace.

SUMMARY OF THE INVENTION

It is, therefore, an object of the present invention to provide a food preparation table which is capable of achieving a more uniform temperature distribution in a food storage compartment by distributing cooled air evenly into the food storage compartment, and is capable of providing a sufficient amount of workspace for maintenance by installing a refrigerating system in a manner that the refrigerating system can be extracted from a chamber for the refrigerating system defined by inner and/or outer walls of the food preparation table.

In accordance with a preferred embodiment of the present invention, there is provided a food preparation table, including: a food storage compartment which preserves foodstuff items; and a cooled air shower device which is disposed above the food storage compartment and supplies cooled air thereinto, wherein the cooled air shower device distributes the cooled air evenly along a substantially entire length of the food storage compartment.

In accordance with another preferred embodiment of the present invention, there is provided a food preparation table, including: a food storage compartment which preserves foodstuff; and a refrigerating system which cools air and supplies the cooled air into the food storage compartment, wherein the refrigerating system is installed in a chamber disposed inside the food preparation table and is extractable therefrom.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

A food preparation table in accordance with a preferred embodiment of the present invention will now be described with reference to the drawings.

Figure 1:
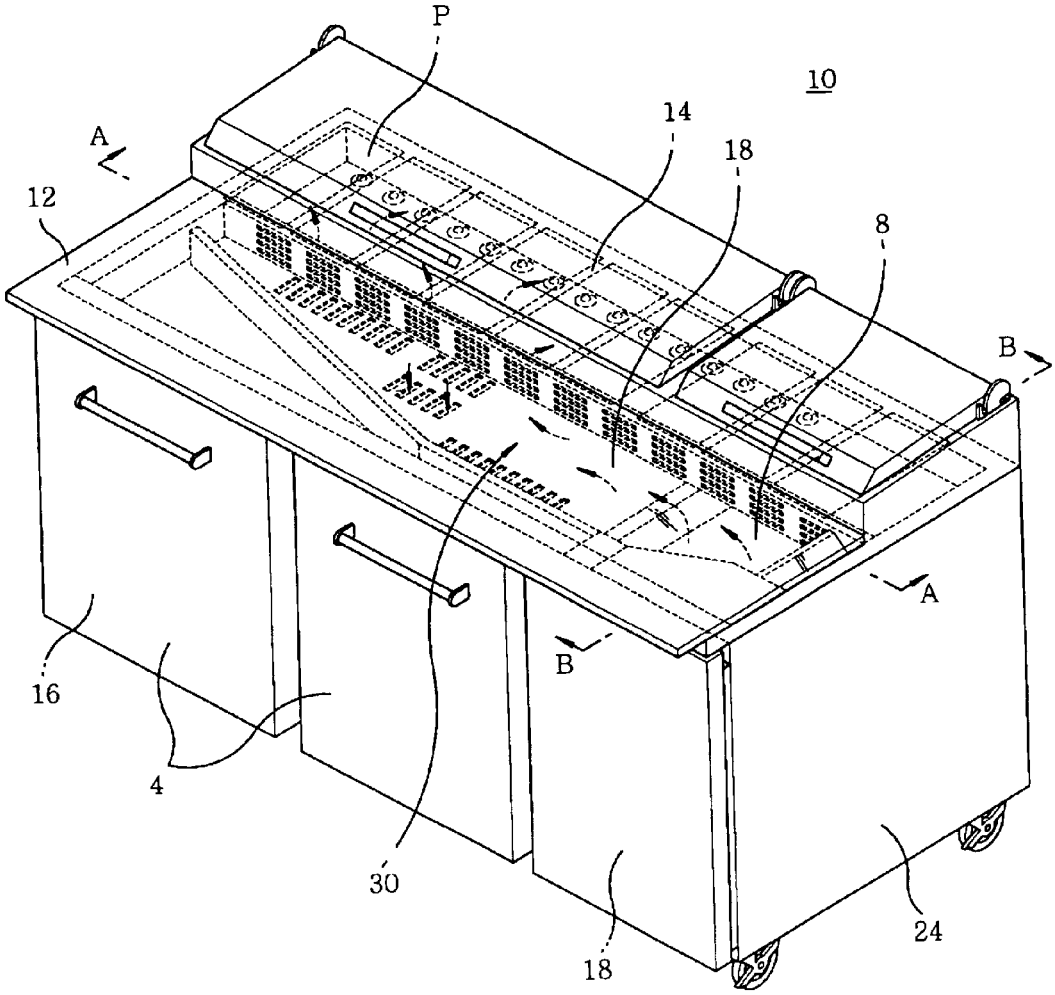
FIG. 1 presents a schematic perspective view of a food preparation table in accordance with a preferred embodiment of the present invention.
Figure 2:
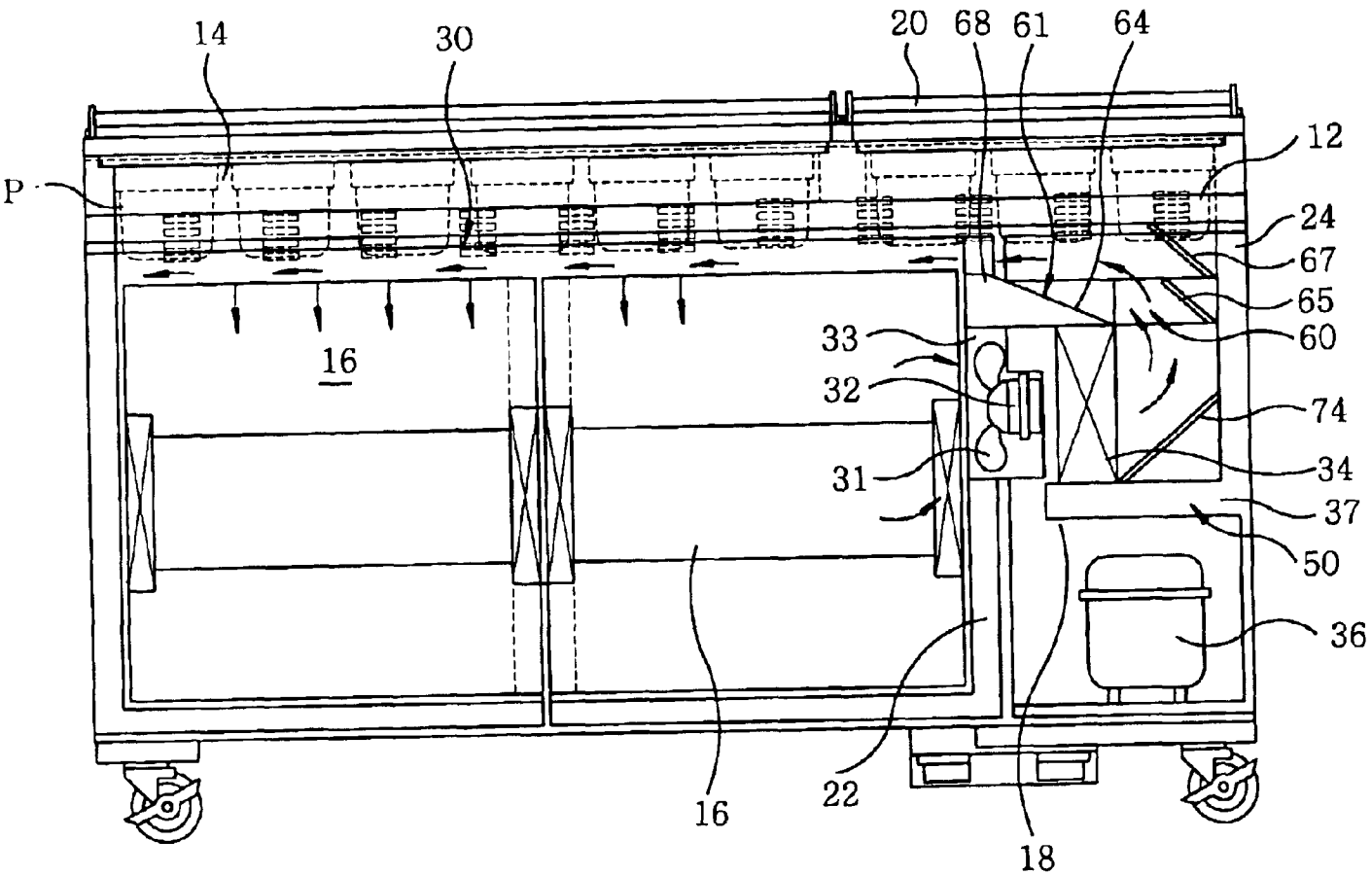
FIG. 2 depicts a schematic cross sectional view taken along line A—A in FIG. 1.
Figure 3:
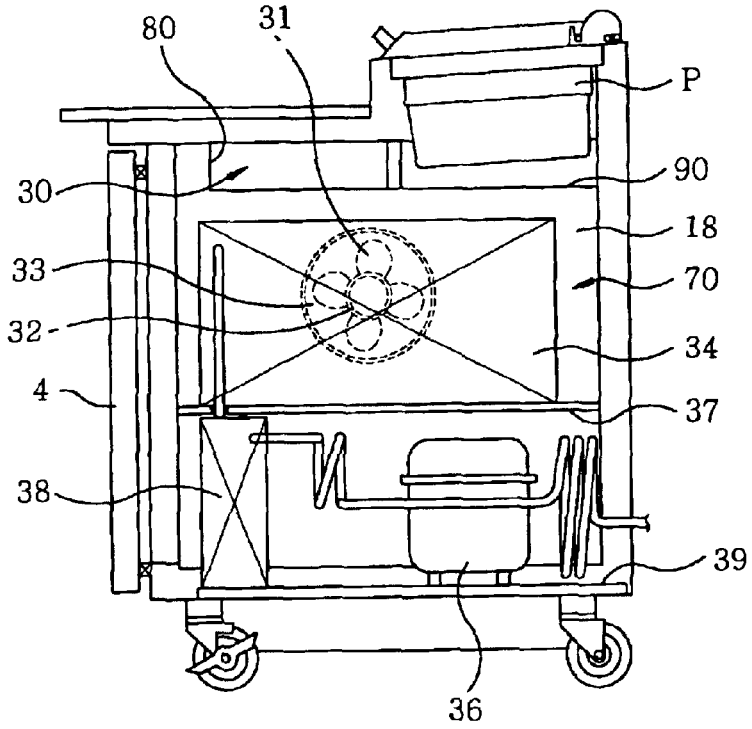
FIG. 3 offers a schematic cross sectional view taken along line B—B in FIG. 1.

Referring to FIG. 1, there is schematically illustrated a schematic perspective view of a food preparation table in accordance with the preferred embodiment of the present invention. And FIGS. 2 and 3 show cross sectional views taken along line A—A and line B—B in FIG. 1, respectively. As sown in FIGS. 1, 2 and 3, the food preparation table 10 includes a counter top 12 for providing a place on which foodstuff, such as pizza or sandwich, is prepared; a pan area 14 disposed on the back side of the counter top 12, which accommodates a plural number of pans P containing ingredient foodstuff items, e.g., sliced tomatoes and lettuces; a food storage compartment 16 disposed below the counter top 12 and the pan area 14, which preserves other items therein; a refrigerating system 50 (shown in FIG. 2) installed in a chamber 18 disposed beside the storage compartment 16, which draws air from the storage compartment 16 and cool it; a cooled air shower device 30 disposed between the counter top 12 and the food storage compartment 16, which distributes the cooled air evenly into the food storage compartment 16; and a guiding means 60 connecting the refrigerating system 50 with the cooled air shower device 30, through which the cooled air flows from the refrigerating system 50 to the cooled air shower device 30.

The storage compartment 16 is defined by insulated walls with a front and a top portion covered with a pair of doors 4 and the cooled air shower device 30, respectively. Between the storage compartment 16 and the refrigerating system chamber 18, an insulated wall 22 (shown in FIG. 2) is disposed and provided with an intake hole 33 through which the refrigerating system room 18 communicates with the storage compartment 16.

The refrigerating system 50 installed in the refrigerating system chamber 18 is provided with a fan 31 for drawing air from the storage compartment 16; a motor 32 for rotating the fan 31; an evaporator 34 disposed behind the fan 31, which cools the air drawn from the storage compartment 16; a condenser 38 (shown in FIG. 3) for supplying a condensed and liquefied refrigerant into the evaporator 34; and a compressor which compresses a refrigerant flowing thereinto from the evaporator 34 and supplies the compressed refrigerant into the condenser 38. The refrigerating system chamber 18 is divided into two sections by an insulated wall 37, one accommodating the evaporator 34 and the fan 31, the other accommodating the condenser 38 and the compressor 36.

As shown in FIG. 2, the guiding means 60 is provided with a first guide panel 74 which allows the cooled air passing through the evaporator 34 to flow upward; a second and a third guide panels 65, 67 which change the upward flow direction of the cooled air to a horizontal direction; and a guide pad 61 for guiding the cooled air to the cooled air shower device 30. The first guide panel 74 is attached to the insulated wall 37 and an outer side wall 24 and slants in a manner that an angle between the flow direction of the cooled air and the first guide panel 74 is set to be about 45°. The second and the third guide panels 65, 67 are attached to the outer side wall 24 in a manner that angles between the outer side wall 24 and the second guide panel 65 and between the outer side wall 24 and the second guide panel 65 are set to be about 45°, wherein the third guide panel 67 is longer than the second guide panel 65 when viewed from a side and does not overlap the second guide panel 65 when viewed from a top. Although the guide panels 74, 65 and 67 are flat panel in this preferred embodiment, a curved panel can be used as the guide panel.

Figure 4:
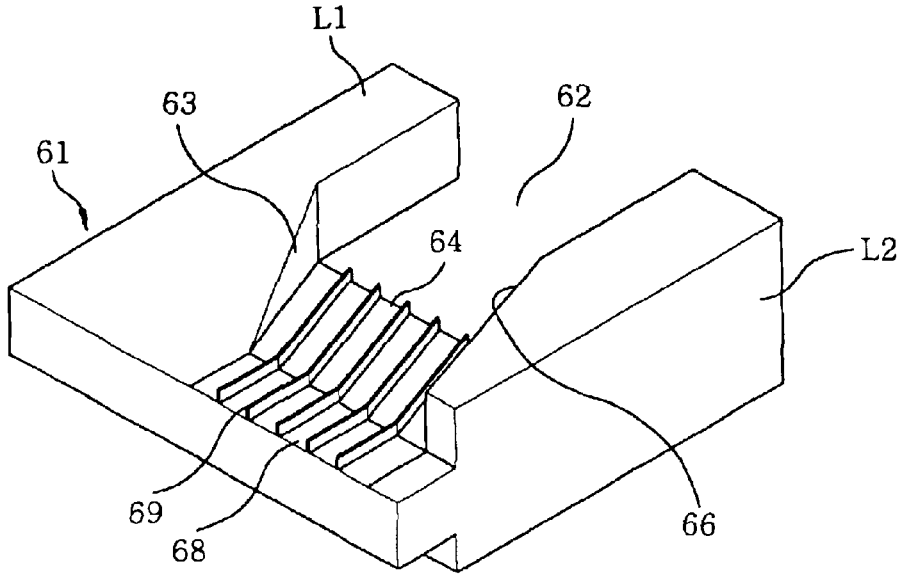
FIG. 4 sets forth a schematic perspective view of a guide pad.

Referring to FIG. 4, there is schematically shown a perspective view of the guide pad 61 of the preferred embodiment. The guide pad 61 is provided with an opening 62 into which the cooled air deflected by the second and the third guide panels 65, 67 is supplied; a channel for guiding the cooled air from the opening 62 to the cooled air shower device 30; and a horizontal portion 68 horizontally connected to the cooled air shower device 30. The opening 62 is formed between a first and second side walls L1 and L2, and the second side wall L2 is thicker than the first side wall L1. One side of the second guide panel 65 is in contact with an inner surface of the first side wall L1 and one side of the third guide panel 67 is in contact with an inner surface of the second side wall L2, which is positioned higher than the inner surface of the first side wall L1. The channel is formed by a first and a second slanting side surfaces 63, 66 and a slant surface 64. A distance between the first and the second slant side surfaces 63, 66 is reduced with a distance from the opening 62. The slant surface 64 slopes downwards from the horizontal portion 68 and is disposed at the approximately same level as the second guide panel 65. The third guide panel 67 is disposed higher than the horizontal portion 68. Further, on the slant surface 64 and the horizontal portion 68, a plural number of guide pins 69 are vertically disposed.

Figure 5:
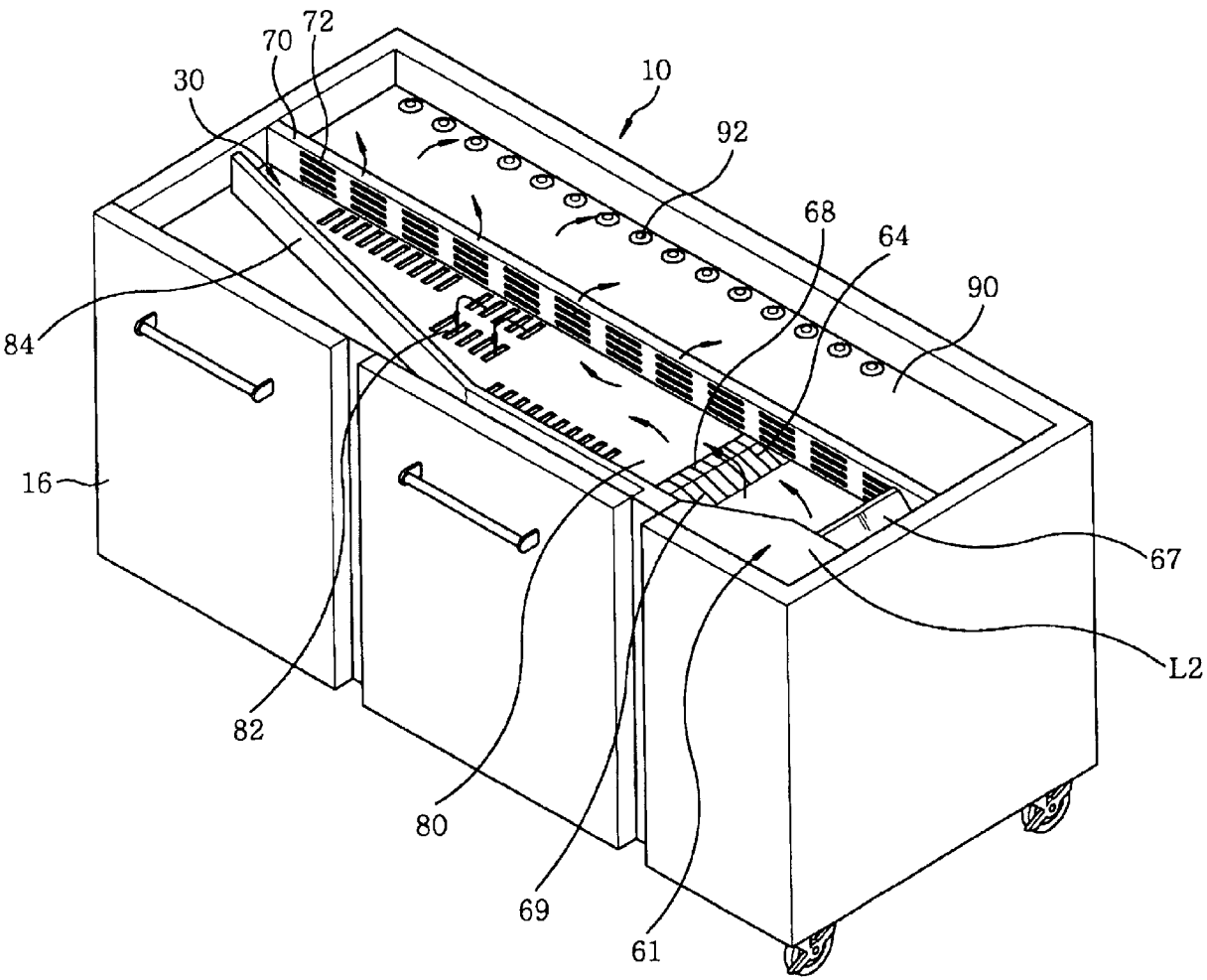
FIG. 5 releases a schematic perspective view of a cooled air shower device installed in the food preparation table in FIG. 1.

Referring to FIG. 5, there is illustrated a perspective view of the cooled air shower device 30. The cooled air shower device 30 is provided with a first duct panel 80 which is horizontally connected to the horizontal portion 68 of the guide pad 61 and has a plurality of louver holes 82; a second duct panel 90 which is disposed below the pan area 14 and has a plurality of embossed holes 92, each embossed hole being a hole formed at a summit portion of embossed portion; and a partition 70 which is disposed between the first duct panel 80 and the second pan duct panel 90 and has a plurality of holes 72 evenly distributed thereon. The second duct panel 90 is disposed above the second guide panel 65 and the partition 70 is installed in a manner that the opposite sides of the side guide panel 67 are in contact with the inner surface of the second side wall L2 and the partition 70, respectively. That is, the third guide panel 67 is disposed between the partition 70 and the second side wall L2. The first duct panel 80 is provided with a guiding wall 84, which is vertically disposed thereon in a manner that a width between the guiding wall 84 and the partition 70 is constant for a certain length and then becomes narrower with a distance from the guide pad 61. The cooled air passing through the guide pad 61 flows into the first duct panel 80 and one portion thereof drops down into the storage compartment 16 through the louver holes 82. At this time, since the louver holes 82 are formed along its substantially entire length and in a manner that the louver holes 82 are symmetric with respect to a center portion of the storage compartment 16, the cooled air is distributed evenly into the storage compartment 16. In addition, since a passage formed between the guiding wall 84 and the partition 70 becomes narrower beyond a certain distance from the guide pad 61, one portion of the cooled air supplied into the first duct panel 80 is distributed into the second duct panel 90 evenly along the partition 70. The cooled air supplied into the pan duct panel 90 absorbs heat from ingredient foodstuff items contained in the pans P and then drops into the storage compartment 16 through the embossed holes 92. Since the embossed holes 92 are linearly disposed in a rear portion of the second duct panel 90, the cooled air can be distributed evenly in a rear portion of the storage compartment 16. The cooled air supplied into the storage compartment 16 is drawn to the evaporator 34 in the refrigerating system room 18 by the fan 31.

Figure 6:
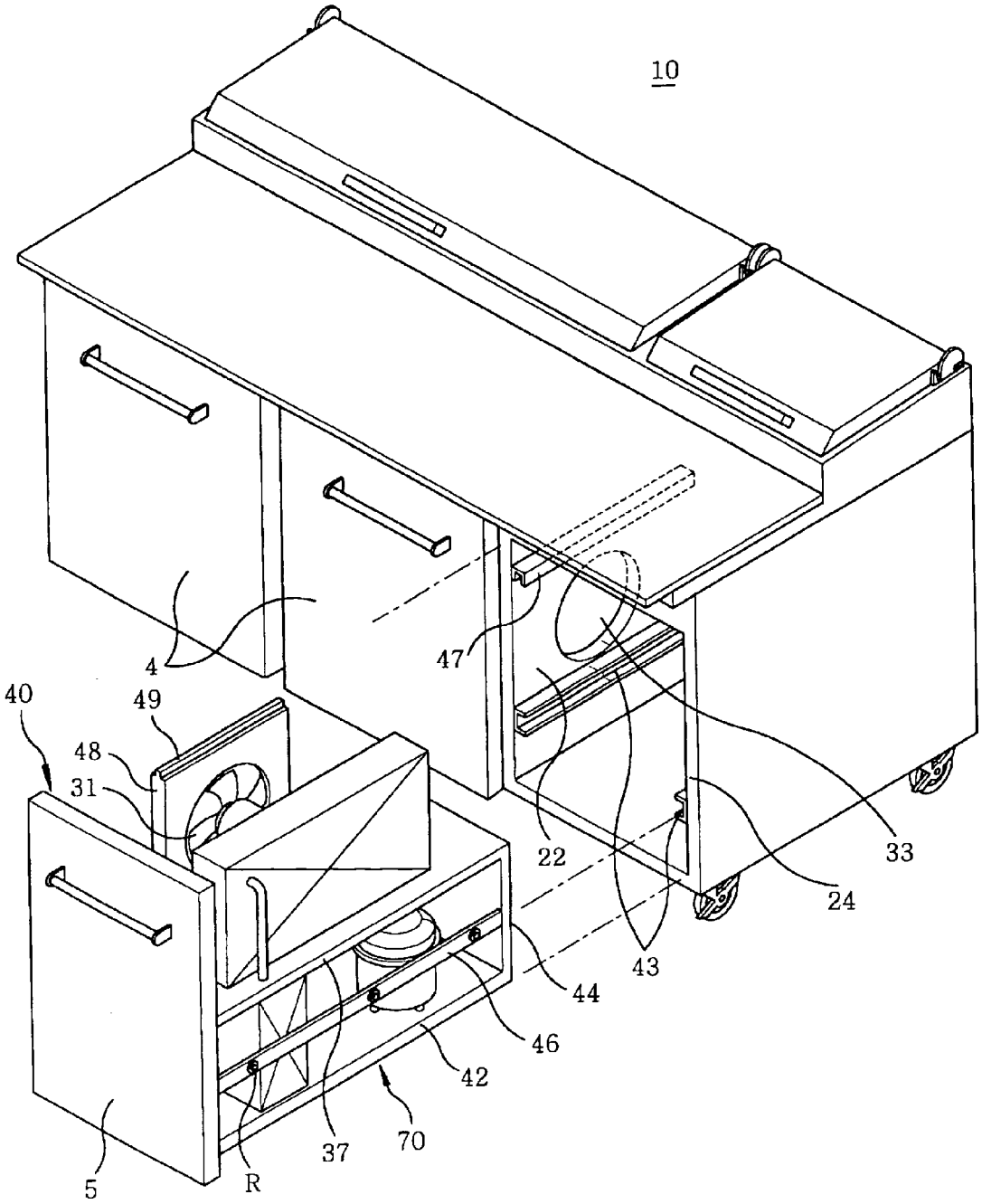
FIG. 6 describes a schematic perspective view of the food preparation table with a refrigerating system extracted from a refrigerating system room.

Referring to FIG. 6, there is schematically illustrated the food preparation table with the refrigerating system 50 extracted from the refrigerating system chamber 18. Since the refrigerating system 50 is mounted on an extracting device 40 which can be extracted from the refrigerating system chamber 18, the refrigerating system 50 can be extracted therefrom. The extracting device 40 is provided with a vertically disposed front wall 5; a rear wall 44 opposite to the front wall 5; a bottom wall 42 connecting the front wall 5 and the rear wall 44, on which the condenser 38 and the compressor 36 are disposed; a pair of sliding portions 46 which are affixed to the front wall 5 and the rear wall 44 and have a plural number of rollers R; and a pair of rails 43 which are fixed to the insulated side wall 22 and the outer side wall 24 and slidably joined with the rollers R of the pair of sliding portions 46, respectively, wherein the insulated wall 37 is attached to the front wall 5 and the rear wall 44. Therefore, when maintenance of the refrigerating system 50 is required, the refrigerating system 50 is extracted from the refrigerating system room 18 by pulling a knob on the front wall 5 of the extracting device 40, so that a sufficient workspace for maintenance is obtained. Further, vertically disposed on the insulated wall 37 is a fan duct member 49 surrounding the fan 31. And the fan duct member 49 is provided with a sliding portion 49 which is slidably inserted into a rail 47 attached to a top wall of the refrigerating system chamber 18.

As described above, since the food preparation table of the present invention distributes evenly cooled air into the storage compartment through the cooled air shower device, the temperature in the storage compartment can be effectively reduced and the temperature distribution therein can be maintained uniformly.

Further, since the refrigerating system of the food preparation table of the present invention can be extracted from the refrigerating system room, a sufficient workspace can be obtained when the maintenance of the refrigerating system is required.

While the invention has been shown and described with respect to the preferred embodiments, it will be understood by those skilled in the art that various changes and modifications may be made without departing from the spirit and scope of the invention as defined in the following claims.

What is claimed is:

1. A food preparation table, comprising:

a food storage compartment which preserves foodstuff items; and a cooled air shower device which is disposed above the food storage compartment and supplies cooled air thereinto, wherein the cooled air shower device distributes the cooled air evenly along a substantially entire length of the food storage compartment, wherein the cooled air shower device includes a first duct panel which is disposed above a front portion of the food storage compartment and has a plurality of holes; a second duct panel which is disposed above a rear portion of the food storage compartment and has a plurality of holes; and a partition which is disposed between the first duct panel and the second duct panel and has a plurality of holes, wherein the plurality of holes of the partition are substantially evenly arranged along substantially entire length of the partition, wherein the cooled air shower device further includes a guiding wall which is vertically disposed in a manner that a width between the partition and the guiding wall is constant for a length and then becomes narrower with a distance from one side of the food storage compartment.

2. The food preparation table of claim 1, wherein the cooled air is supplied into the duct panel and one portion of the cooled air supplied into the duct panel is then supplied into the other duct panel through the plurality of holes formed in the partition.

3. The food preparation table of claim 1, further comprising a guiding means for guiding the cooled air to the cooled air shower device, wherein the guiding means includes a first guide panel which makes the cooled air flow upward.

4. The food preparation table of claim 3, wherein the guiding means further includes a second guide panel which allows the cooled air to flow in a horizontal direction.

5. The food preparation table of claim 4, wherein the guiding means further includes a guide pad which guides the cooled air deflected by the second guide panel to the cooled air shower device.

6. The food preparation table of claim 1, further comprising:

a refrigerating system which cools air and supplies the cooled air into the food storage compartment, wherein the refrigerating system is installed in a chamber disposed inside the food preparation table and is extractable therefrom.

7. The food preparation table of claim 6, wherein the refrigerating system is mounted on a extracting device, and the extracting device includes a pair of sliding portions, the pair of sliding portions being slidably joined with a pair of rails provided opposite inner sides of the chamber.

* * * * *